US009044649B2

(12) United States Patent
Choi

(10) Patent No.: US 9,044,649 B2
(45) Date of Patent: Jun. 2, 2015

(54) DEVICE FOR AUTOMATICALLY SUPPLYING GOLF BALLS

(76) Inventor: Jae-Woo Choi, Seoul (KR)

( * ) Notice: Subject to any disclaimer, the term of this patent is extended or adjusted under 35 U.S.C. 154(b) by 0 days.

(21) Appl. No.: 14/125,496

(22) PCT Filed: Jun. 13, 2012

(86) PCT No.: PCT/KR2012/004640

§ 371 (c)(1),
(2), (4) Date: Dec. 11, 2013

(87) PCT Pub. No.: WO2012/177007

PCT Pub. Date: Dec. 27, 2012

(65) Prior Publication Data

US 2014/0113735 A1 Apr. 24, 2014

(30) Foreign Application Priority Data

Jun. 13, 2011 (KR) ..... 10-2011-0060960

(51) Int. Cl.
*A63B 69/36* (2006.01)
*A63B 47/00* (2006.01)
*A63B 57/00* (2006.01)

(52) U.S. Cl.
CPC ..... *A63B 47/002* (2013.01); *A63B 57/0006* (2013.01)

(58) Field of Classification Search
CPC ..... A63B 47/002; A63B 2047/004; A63B 57/0006
USPC ..... 473/132–137
See application file for complete search history.

(56) References Cited

U.S. PATENT DOCUMENTS

| | | | | |
|---|---|---|---|---|
| 4,957,296 | A * | 9/1990 | Turnidge et al. | 473/137 |
| 5,611,737 | A * | 3/1997 | Rau et al. | 473/137 |
| 6,375,580 | B1 * | 4/2002 | Schmidt et al. | 473/137 |
| 6,984,178 | B1 * | 1/2006 | Chen | 473/136 |
| 2005/0282646 | A1 | 12/2005 | Chen | |
| 2014/0113735 | A1 * | 4/2014 | Choi | 473/136 |

FOREIGN PATENT DOCUMENTS

| | | | |
|---|---|---|---|
| KR | 0069498 | A | 10/1998 |
| KR | 002128 | U | 1/1999 |
| KR | 0137418 | B1 | 8/2007 |
| KR | 0117126 | A | 12/2009 |

* cited by examiner

*Primary Examiner* — Steven Wong
(74) *Attorney, Agent, or Firm* — AKC Patents, LLC; Aliki K. Collins

(57) ABSTRACT

A novel device for automatically supplying golf balls. A stopper, a golf ball lifting part, an inclined guide part and an inclined lifting part disposed inside a main body cooperate with each other to automatically lift a golf ball from a rear portion of the main body by placing the golf ball on a lifting tee so that a golfer can hit the ball using a driver. An iron shot hitting part is further provided at one side of the main body so that the golfer can practice driver shots and iron shots concurrently and conveniently at the same time. The lifting tee is inclined to the left in order to supply a ball seated on the inclined lifting part to the iron shot hitting part. The iron shot hitting part has a plurality of detection recesses with which a golfer or a beginner can correct his/her posture.

27 Claims, 11 Drawing Sheets

DEVICE FOR AUTOMATICALLY SUPPLYING GOLF BALLS

CROSS-REFERENCE TO RELATED APPLICATION

This application claims the benefit of Korean Patent Application No. 10-2011-0060960, filed on Jun. 23, 2011 in the Korean Intellectual Property Office, the disclosure of which is incorporated herein by reference.

TECHNICAL FIELD

The present invention relates to a device for automatically supplying golf balls, and more particularly, to one in which a stopper, a golf ball lifting part, an inclined guide part and an inclined lifting part which are disposed inside a main body cooperate with each other to supply a golf ball which is supplied through a golf ball supplying part onto a tee-up part so that the golf ball is seated on a lifting tee of the tee-up part which is automatically lifted and lowered so that a golfer can hit the golf ball on the lifting tee using a driver, and in which an iron shot hitting part having detection recesses is further provided at one side of the main body so that the golfer can practice driver shots and iron shots at the same time.

BACKGROUND ART

In general, golf is a sport game, the object of which is to deposit a small and round ball into a hole using few strokes as possible. Golf is popular among a wide range of people.

In order to enjoy golf, it is very important to have a skill to hit a golf ball in an intended direction in order to place the ball at an intended position. In general, golfers practice skills in indoor and/or outdoor golf practice ranges before playing on outdoor courses.

That is, a device for automatically supplying golf balls of the related art serves to automatically put golf balls onto a tee made of a tubular elastic member on the ground as the golf balls are automatically supplied from underground so that a user is not required to seat golf balls on the tee. (The tee is a small peg stuck in the ground in order to hold a golf ball at a preset height from the ground)

Such a device for automatically supplying golf balls to a user in a golf practice range is also referred to as a tee-up device.

The device for automatically supplying golf balls is made into a variety of shapes. The device is generally configured such that it lifts a golf tee on which a golf ball is to be seated from a box-shaped frame using a cylinder or a drive motor disposed at the bottom of the frame.

However, the device for automatically supplying golf balls has a problem in that a golf ball supplying part fails to reliably supply golf balls onto a golf tee or correctly seat golf balls onto the golf tee due to the difference between a speed at which the golf tee is lifted and a speed at which a golf ball transport part transports golf balls.

In addition, in the device for automatically supplying golf balls, golf balls are seated on the golf tee which is automatically lifted and lowered so that only driver shots can be practiced. Consequently, the device for automatically supplying golf balls does not supply golf balls to a position where iron shots can be practiced, which is problem.

DISCLOSURE

Technical Problem

The present invention provides a novel device for automatically supplying golf balls in which a stopper, a golf ball lifting part, an inclined guide part and an inclined lifting part which are disposed inside a main body cooperate with each other to automatically lift a golf ball from a rear portion of the main body by placing the golf ball on a lifting tee so that a golfer can hit the golf ball using a driver, and in which an iron shot hitting part is further provided at one side of the main body so that the golfer can practice driver shots and iron shots concurrently and conveniently at the same time. The lifting tee is inclined to the left in order to supply a golf ball seated on the inclined lifting part to the iron shot hitting part. The iron shot hitting part has a plurality of detection recesses with which a golfer or a beginner can correct his/her posture.

Technical Solution

In order to overcome the foregoing problem, the present invention is characterized by a main body including a plurality of plate members which are spaced apart from each other to define a transport space part; a golf ball supplying part disposed in a front lower portion of the main body; and an eccentric cam disposed on a drive shaft of a motor disposed on an upper central portion of one surface of the main body. The drive shaft is disposed in the transport space part. The present invention is also characterized by a golf ball lifting part including a drive bar for receiving a golf ball from the golf ball supplying part. The drive bar is connected to a first pivot member fitted around a first pivot shaft disposed in front of the drive shaft, a rear portion of the drive bar is inclined in a back to front direction so as to be driven through an operation of the eccentric cam, and the drive bar has a lifting part in a front portion thereof. The present invention is also characterized by an inclined guide part disposed towards the front of the golf ball lifting part and behind a stopper. The inclined guide part has a slope for receiving the golf ball lifted on the golf ball lifting part. The present invention is also characterized by an inclined lifting part disposed in front of a second pivot member fitted around a second pivot shaft disposed behind and above the drive shaft. The inclined lifting part including a lifting bar having a slope which faces the inclined guide part so as to receive the golf ball guided on the inclined guide part. The present invention is also characterized by a tee-up part including a link, a gear and a chain. One end of the link is disposed at an exposed drive shaft of the drive shaft which extends through the plate member so as to be exposed. The gear is disposed behind and above the plate member. A front portion of the chain is connected to the other end of the link, a lower portion of the chain moves on an outer circumference of the gear, and a rear portion of the chain is connected to a lifting part.

In addition, the present invention is characterized in that the stopper is disposed between the golf ball supplying part and the golf ball lifting part. The stopper is disposed in a front lower portion of the main body, and pivots on a hinge in order to open and close an outlet of the golf ball supplying part so that the golf ball enters and exits a lower portion of the transport space part. A lower fixing protrusion is formed on the stopper and is disposed using a first return spring so as to be connected to a fixing protrusion formed on a portion of the main body.

In addition, the present invention is characterized in that the golf ball lifting part includes the drive bar and a catching projection provided on a front portion of the drive bar. The drive bar is disposed on the first pivot member, is driven with one portion thereof being butted to an inner surface of the plate member, and is inclined with a rear portion thereof being butted to a bottom surface of the eccentric cam. A front portion of the drive bar is bent toward the other side to provide a lifting part which lifts the golf ball. The catching projection presses an upper front portion of the stopper.

In addition, the present invention is characterized in that the tee-up part further includes a plurality of lift rods which is disposed on a base plate, a lifting plate which is connected to an inner surface of the lifting part which is lifted along the plurality of lift rods, and a lifting tee which is disposed behind and inward from the lifting plate to receive the golf ball from the inclined lifting part.

In addition, the present invention is characterized in that the golf ball lifting part includes a lift hole formed in a surface of the main body, a fixing protrusion disposed on a rear portion of the golf ball lifting part, the fixing protrusion adjoining the drive shaft and extending through the lift hole so as to be exposed, a lower fixing protrusion formed below the lift hole, and a second return spring connecting the fixing protrusion to the lower fixing protrusion.

In addition, the present invention is characterized in that the golf ball supplying part is formed as a cylinder that a plurality of the golf balls enters and exits, and is disposed in front of the main body at an incline.

In addition, the present invention is characterized in that the tee-up part further includes a pivot shaft which extends through the lifting plate, a fixing part which has a fixing hole in a rear portion thereof to which a front portion of the pivot shaft is fixed, and a fixing hole which is formed in an upper portion and a front portion of the fixing part which are connected to each other. A lower portion of the lifting tee is fixed to the fixing hole.

In addition, the present invention is characterized in that a guide recess is formed in the plate member positioned at the other side of the fixing part.

In addition, the present invention is characterized in that the tee-up part further includes a pivoting part which is disposed on an outer circumference of the pivot shaft exposed behind the lifting plate, a driving part which is provided at one side of the fixing part and has a driving shaft portion communicating with a drive motor, and a third return spring which connects the driving shaft portion to a lower fixing part formed on a lower portion of the pivoting part In addition, the present invention is characterized in that the tee-up part further includes a fourth return spring which connects an upper portion of the driving part to an upper fixing portion formed on an upper portion of the pivoting part.

In addition, the present invention is characterized in that a fixing pivot pin which fixes a front portion of the link is disposed on a protruding reinforcement plate disposed on the other surface of the front portion of the main body.

In addition, the present invention is further characterized by an iron shot hitting part which is provided at one side of the main body.

In addition, the present invention is characterized in that the iron shot hitting part includes a first seating plate disposed at a bottom, a second seating plate seated on the first seating plate, a fixing plate seated on the second seating plate, and a grass part disposed on the fixing plate.

In addition, the present invention is characterized in that the first seating plate includes a plurality of springs disposed on an upper periphery thereof.

In addition, the present invention is characterized in that the second seating plate includes a plurality of guide recesses formed in an upper periphery thereof and a plurality of detection recesses formed in a central portion thereof.

In addition, the present invention is characterized in that transport rolls are disposed in the guide recesses, and sensors are disposed in the detection recesses In addition, the present invention is characterized in that each of the fixing plate and the grass part has an exposure hole in a central portion thereof through which the detection recesses of the second seating plate are exposed.

In addition, the present invention is characterized in that the iron shot hitting part includes the motor and a control part which controls the drive motor.

In addition, the present invention is characterized in that the sensors are controlled by the control part.

In addition, the present invention is characterized in that the control part is connected to a display part.

In addition, the present invention is characterized in that the lifting tee includes a space part which is formed inside the lifting tee, a through-hole which is formed in a lower portion of the space part to communicate with the space part, a wire, a portion of which is inserted into the through-hole and the space part, and another portion of which is exposed below the through-hole, upper and lower fixed rings respectively fixed to upper and lower portions of the wire, an inner movable ring which is positioned at a bottom of the space part and into which the wire is fitted, an outer movable ring which is positioned on a bottom surface of the lifting tee and into which the wire is fitted, an inner spring which is positioned between the upper fixed ring and the inner movable ring and into which the wire is fitted, and an outer spring which is positioned between the outer movable ring and the lower fixed ring and into which the wire is fitted.

In addition, the present invention is characterized in that the grass part includes a base plate disposed at a bottom, an elastic member disposed on the base plate, and a number of grass seedlings disposed on an upper portion of the elastic member.

In addition, the present invention is characterized in that the second seating plate includes a pressure sensor and a limit switch disposed on a front inner portion thereof. The pressure sensor is connected to the control part.

In addition, the present invention is characterized in that the eccentric cam includes a plurality of bearings disposed on an outer circumference of the eccentric cam.

In addition, the present invention is characterized in that the stopper includes a guide roll which is positioned above the stopper, and is disposed in a front portion of the main body.

In addition, the present invention is characterized in that the grass part includes a number of grass seedlings and a protruding grass seedling, the protruding grass seedling being provided on a central portion of the grass part and is longer than the number of grass seedlings in a longitudinal direction.

In addition, the present invention is characterized in that the number of grass seedlings and the protruding grass seedling have different colors.

Advantageous Effects

According to the present invention, the stopper, the golf ball lifting part, the inclined guide part and the inclined lifting part which are disposed inside the main body precisely cooperate with each other to supply a golf ball onto the lifting tee which is continuously and automatically lifted at the tee-up part through the golf ball supplying part so that a golfer or a beginner can easily and conveniently hit the ball seated on the lifting tee using a driver.

In addition, according to the present invention, the lifting tee of the inclined lifting part is inclined to the left in order to supply a golf ball seated on the lifting tee to the detection recesses of the iron shot hitting part. When a golfer or a beginner hits the golf ball on the iron shot hitting part using an iron, the lower portion of the head of the iron comes into contact with the detection recesses. Accordingly, the golfer or beginner can correct his/her posture while practicing iron shots.

MODE FOR INVENTION

Figure 1:
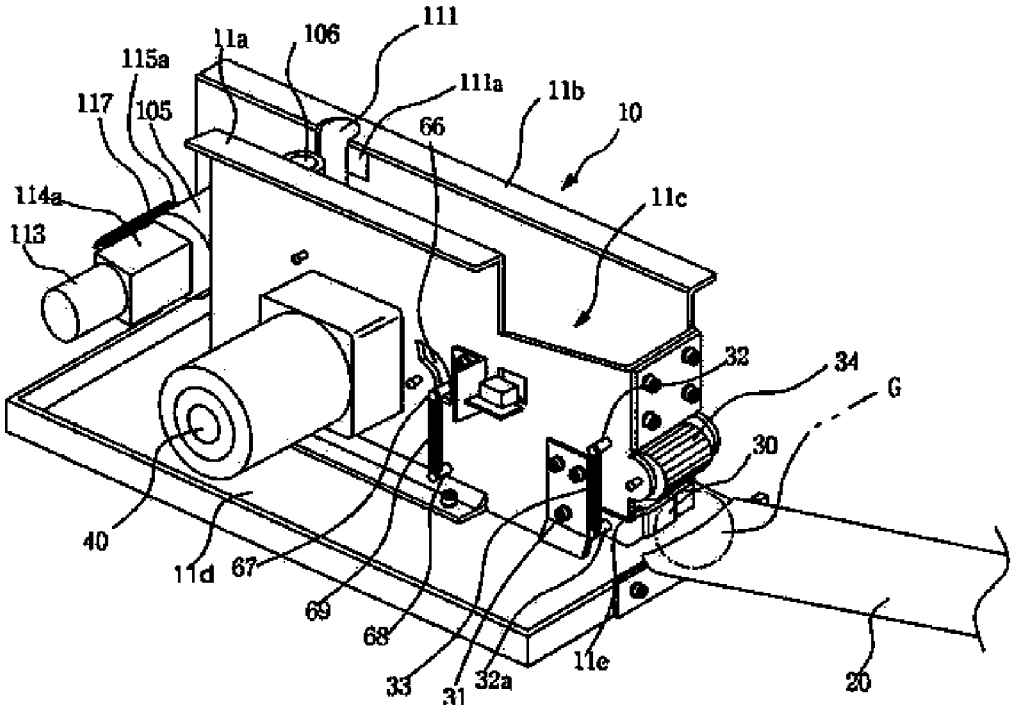
FIG. 1 is a perspective view of the present invention.

Reference will now be made in detail to exemplary embodiments of the present invention in conjunction with the accompanying drawings in order to enhance understanding of the concept of the present invention.

The embodiments of the present invention are not exclusive and many modifications are possible. It should not be understood that the scope of the present invention be limited to the following detailed descriptions of the embodiments. The following embodiments are provided in order to more fully convey the scope of the invention to a person skilled in the art.

Therefore, the shapes and dimensions of elements in the drawings may be exaggerated for clarity. Throughout the drawings, the same reference numerals will be used to refer to the same or like elements.

In addition, detailed descriptions of known functions and elements will be omitted when they may make the subject matter of the present invention unclear.

Figure 2:
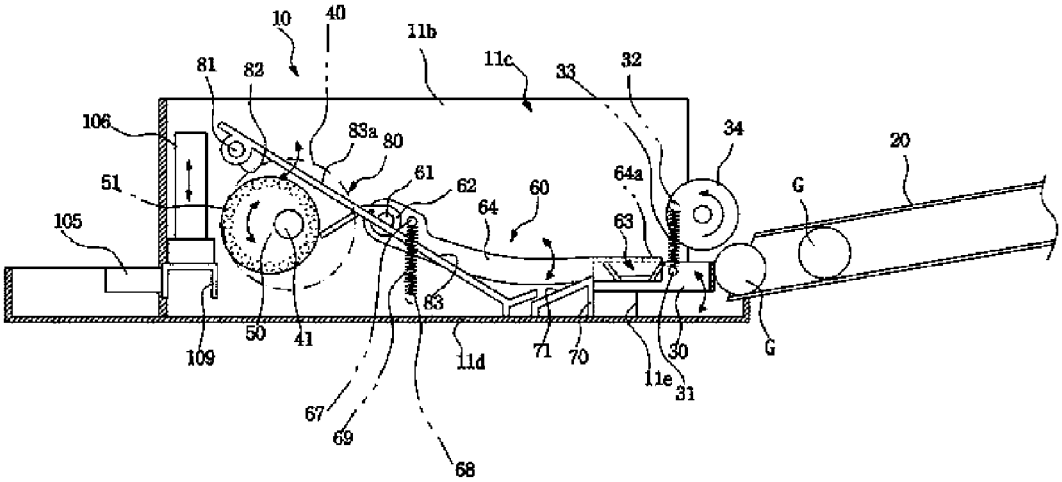
FIG. 2 is a schematic cross-sectional view of the present invention.
Figure 3:
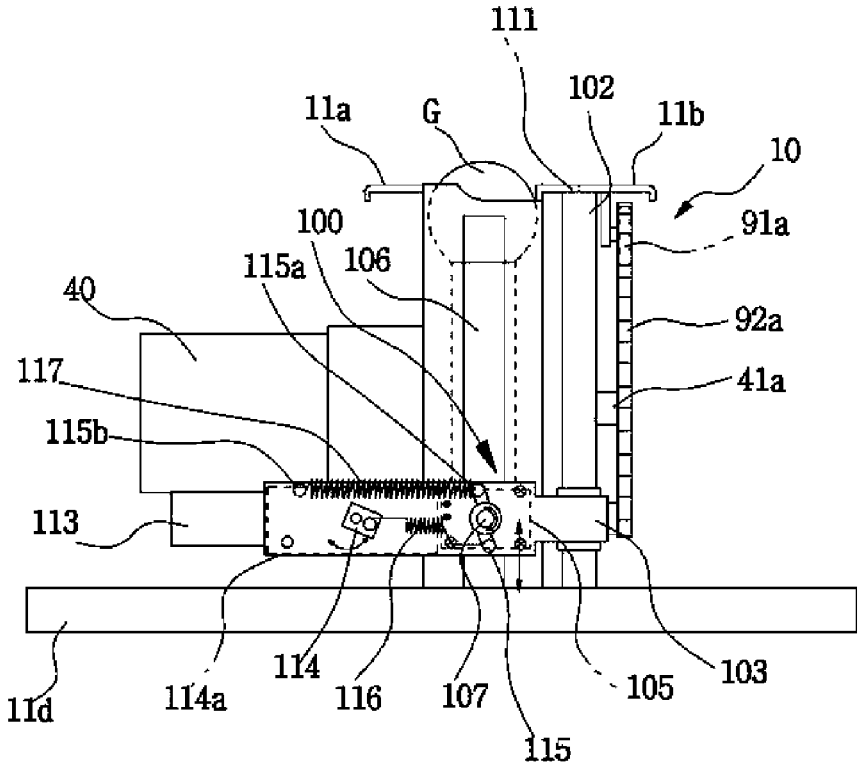
FIG. 3 is a left side elevation view of the present invention.
Figure 4:
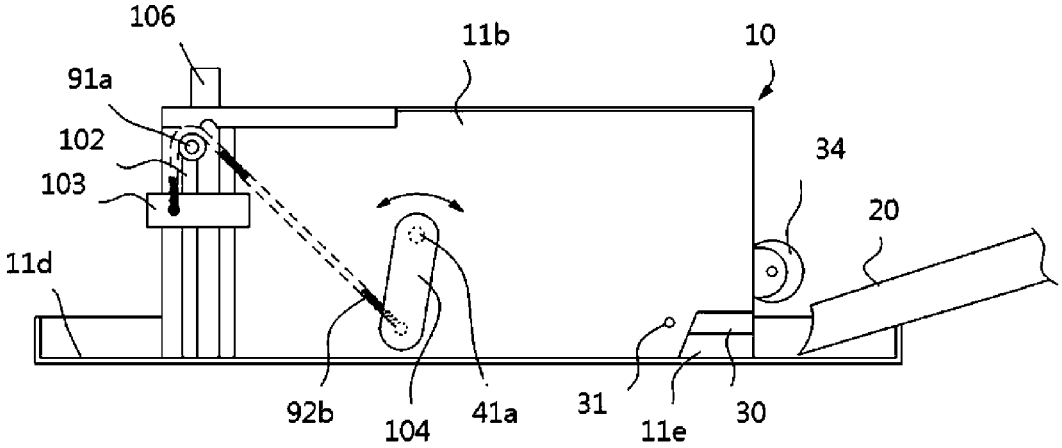
FIG. 4 is a rear elevation view of the present invention.
Figure 5A:
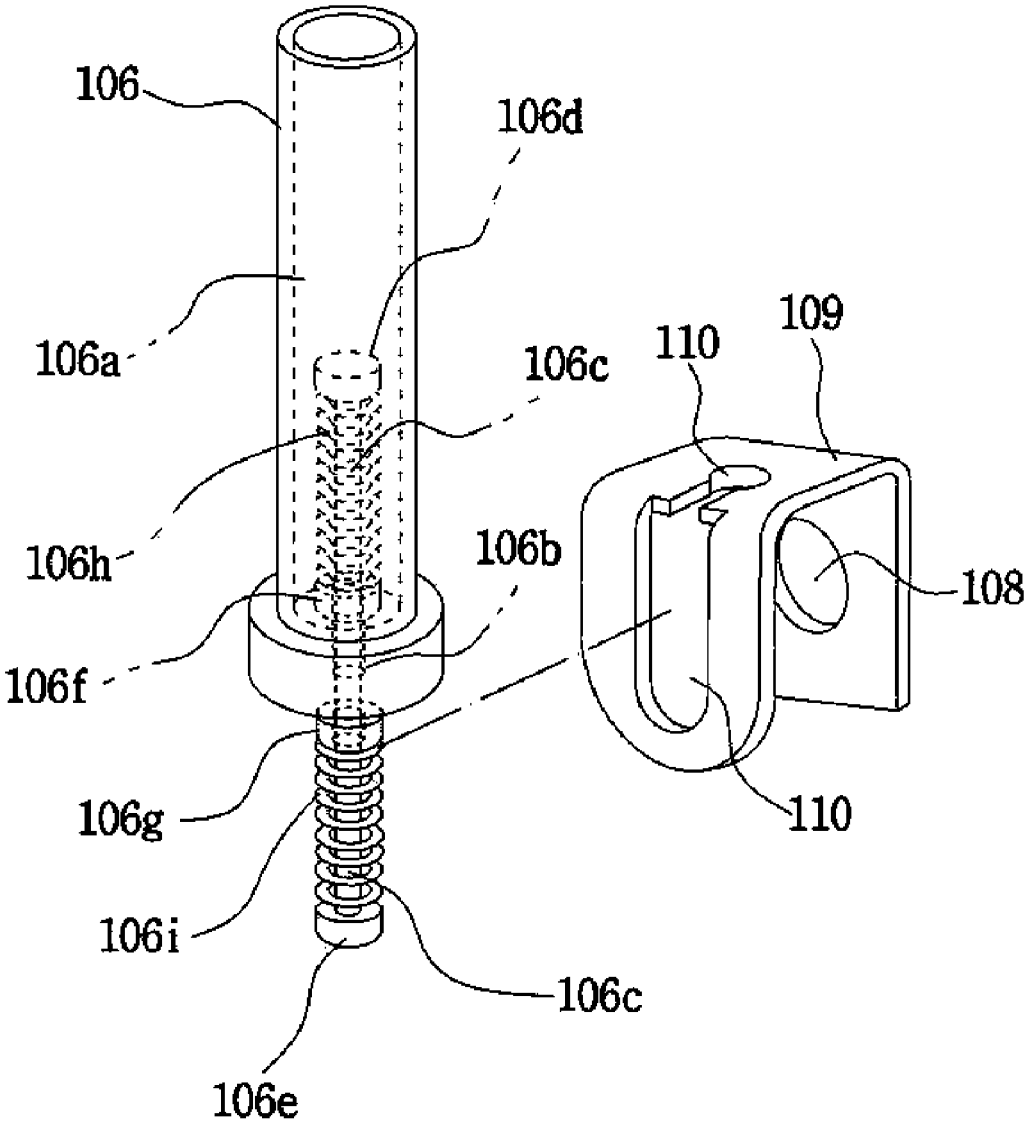
FIG. 5*a* is an exploded perspective view of the tee-up part and the fixing part according to the present invention.
Figure 5B:
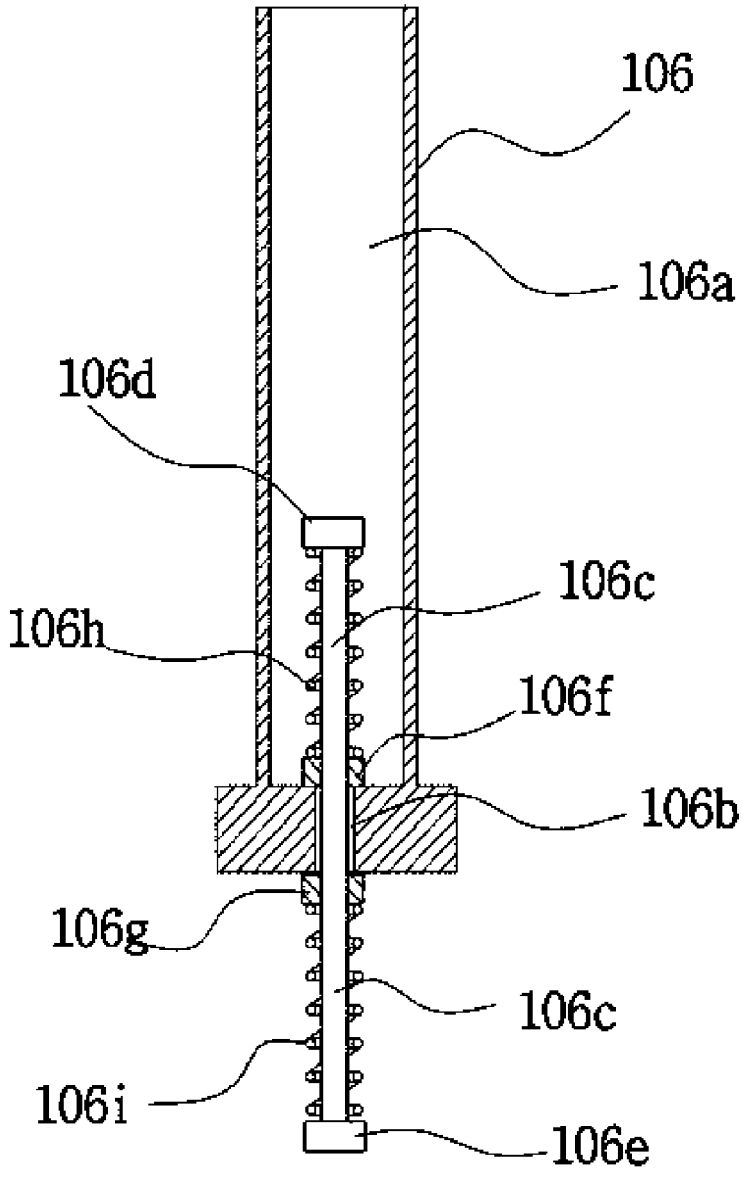
FIG. 5*b* is a cross-sectional view of the tee-up part according to the present invention.
Figure 6:
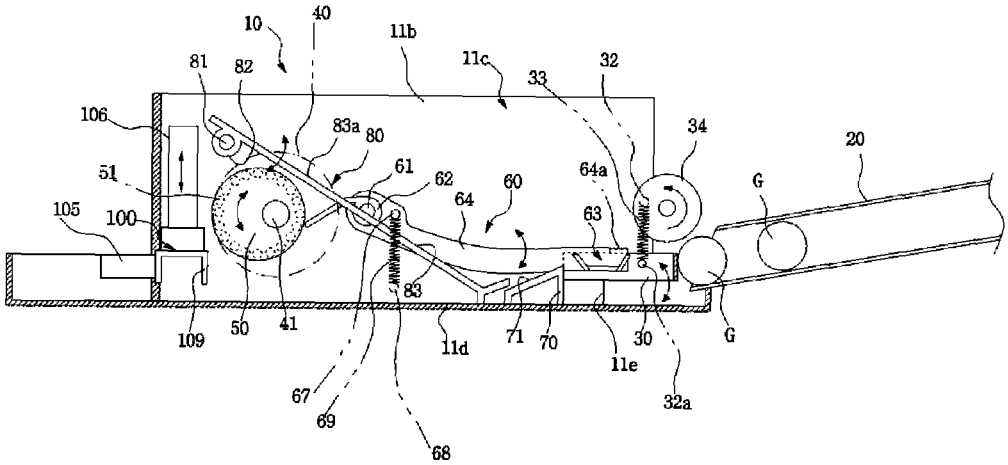
FIG. 6 to FIG. 9 are schematic cross-sectional view showing the operation of the lifting tee of the tee-up part according to the present invention.
Figure 10:
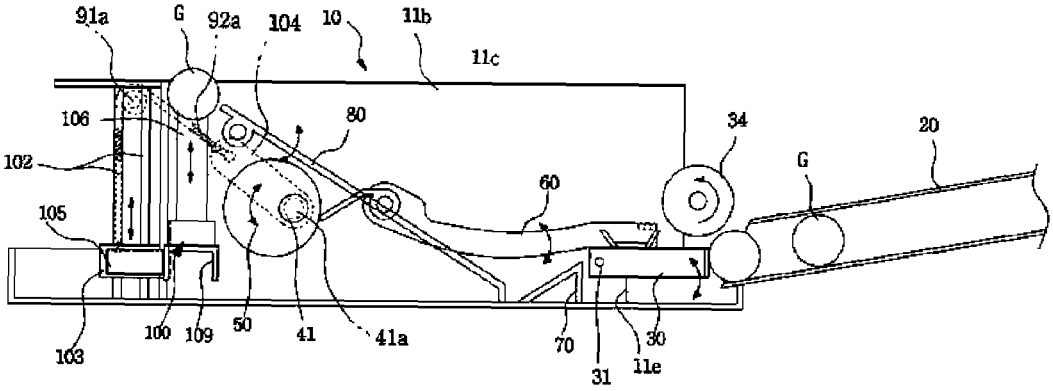
FIG. 10 to FIG. 11 are schematic cross-sectional view showing the operation of the rotating disk, the link and the tee-up part according to the present invention.
Figure 11:
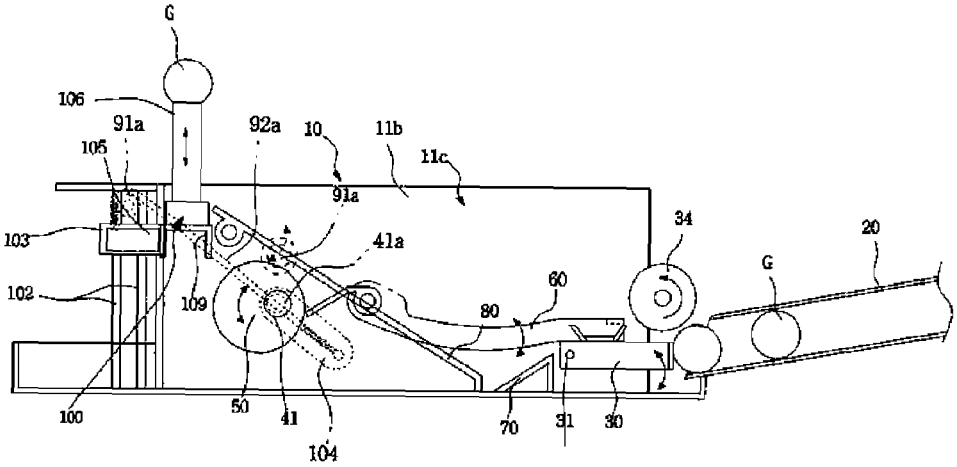
Figure 12:
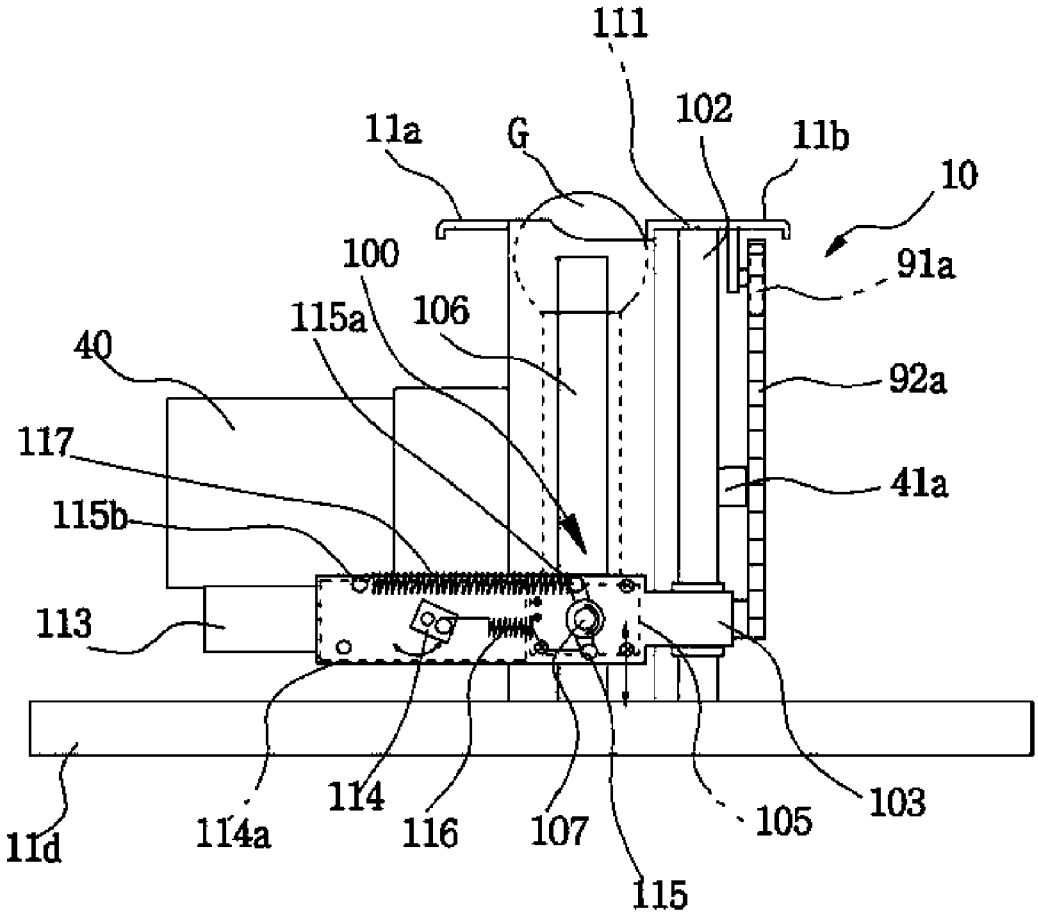
FIG. 12 to FIG. 14 are schematic views showing the state where the lifting tee of the tee-up part according to the present invention is inclined.
Figure 13:
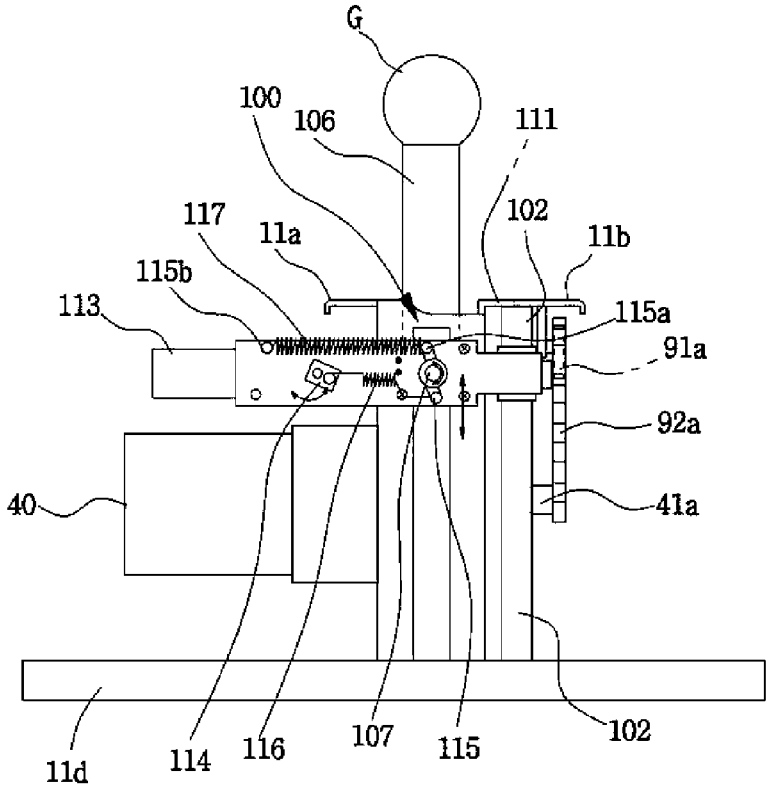
Figure 14:
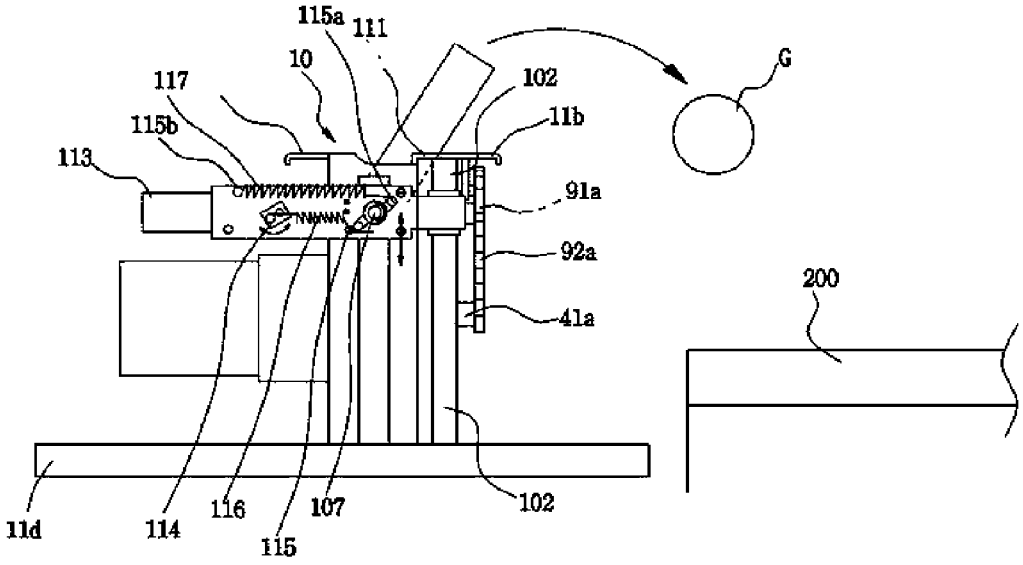
Figure 15:
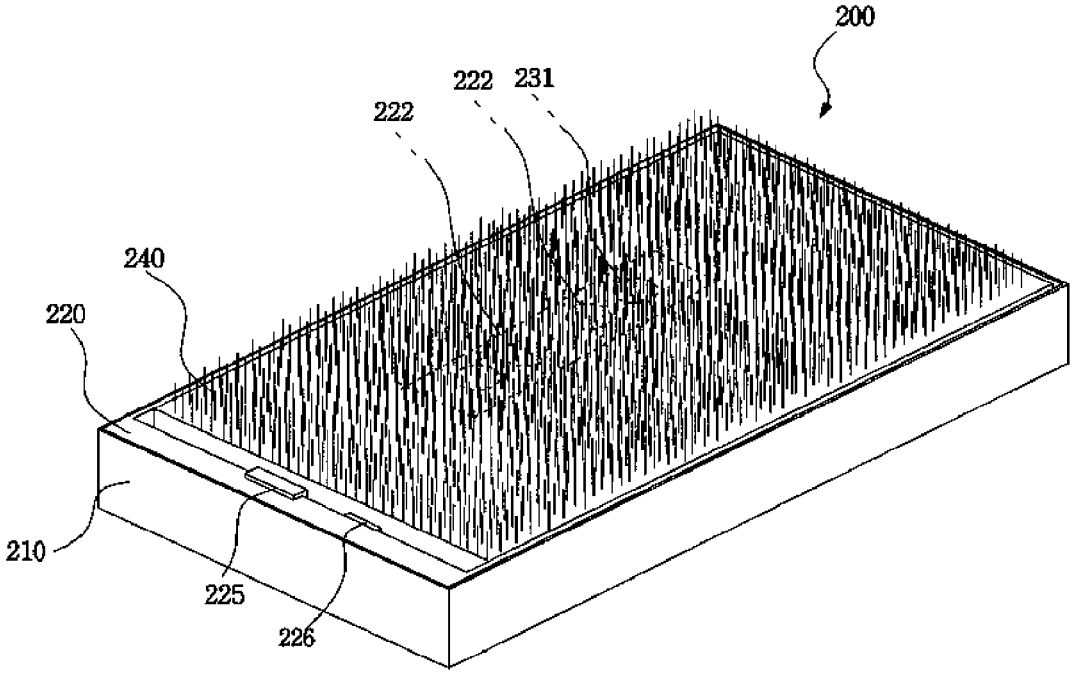
FIG. 15 is a perspective view showing the iron shot hitting part according to the present invention.
Figure 16:
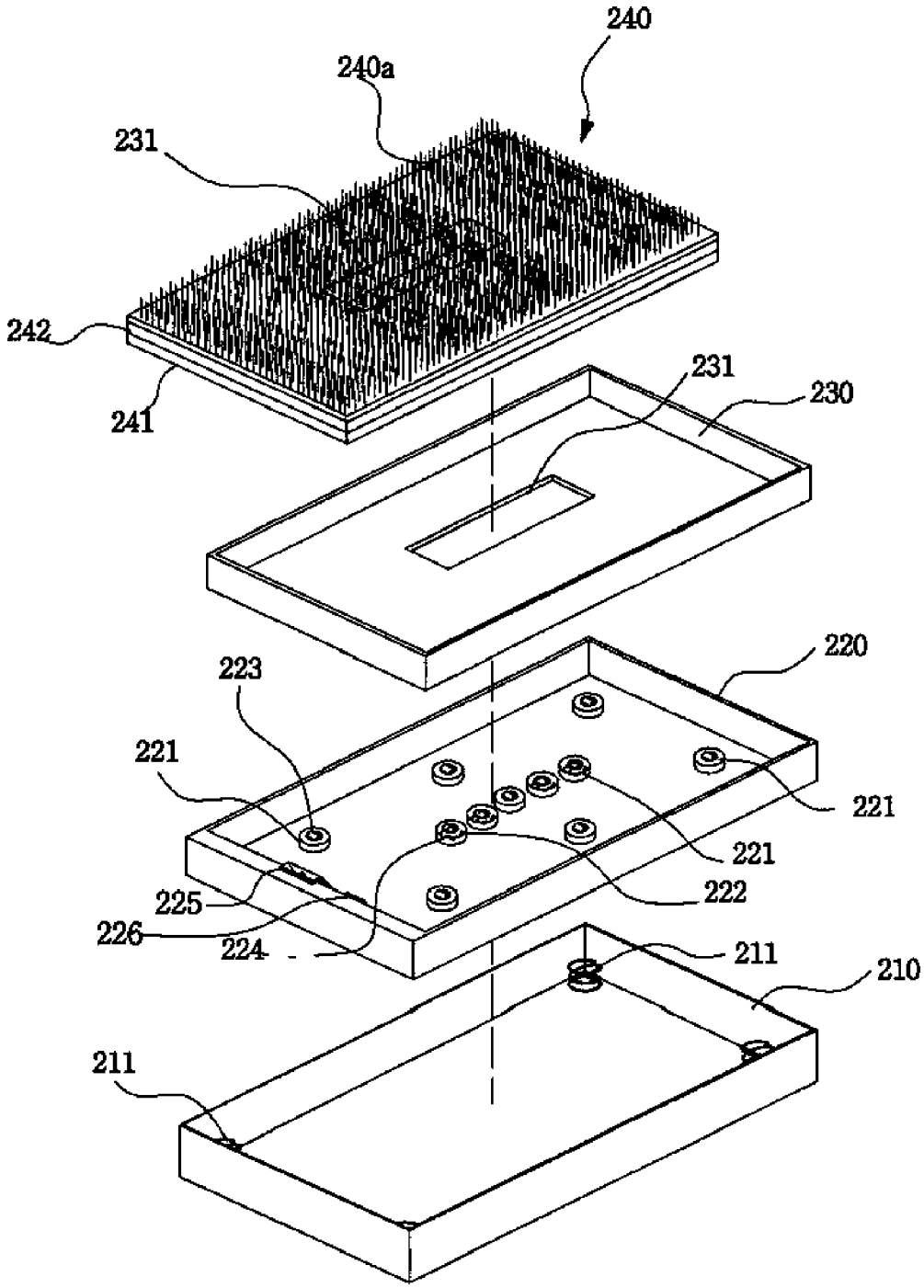
FIG. 16 is an exploded perspective view of the iron shot hitting part according to the present invention.
Figure 17:
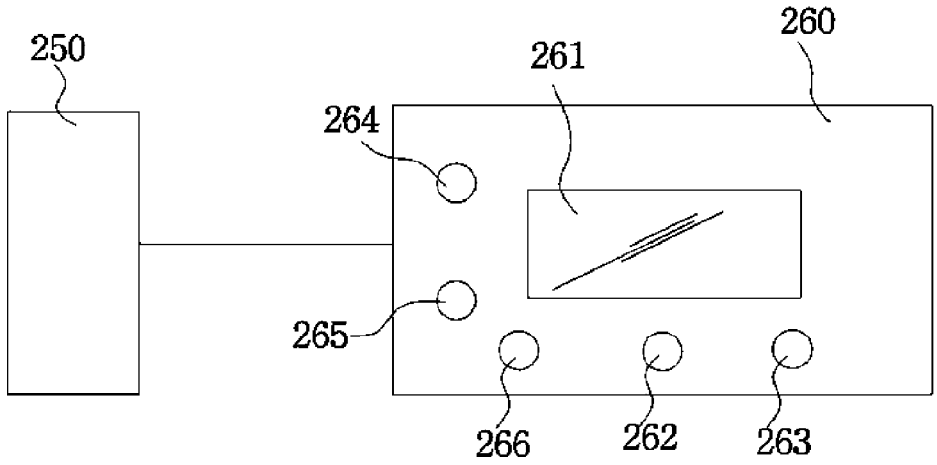
FIG. 17 is a schematic view showing a control part and a display part according to the present invention.
Figure 18:
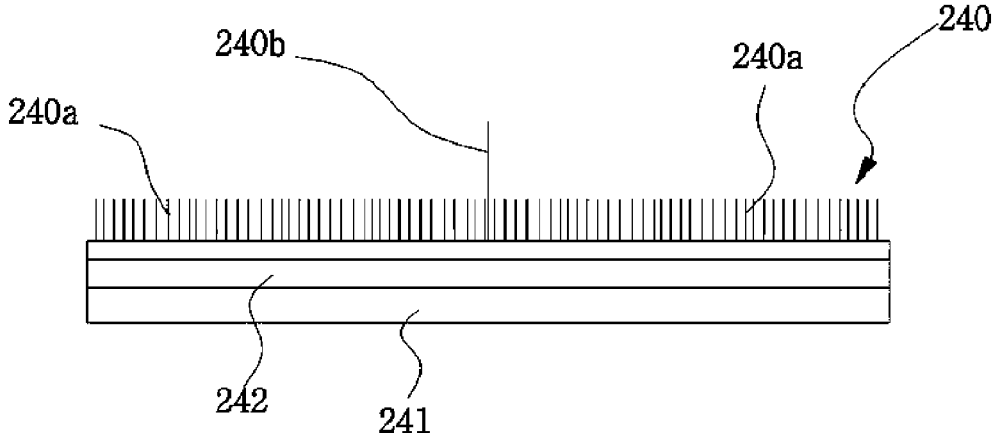
FIG. 18 is a schematic cross-sectional view of the grass part according to the present invention.

FIG. 1 is a perspective view of the present invention, FIG. 2 is a schematic cross-sectional view of the present invention, FIG. 3 is a left side elevation view of the present invention, FIG. 4 is a rear elevation view of the present invention, FIG. 5*a* is an exploded perspective view of the tee-up part and the fixing part according to the present invention, FIG. 5*b* is a cross-sectional view of the tee-up part according to the present invention, FIG. 6 to FIG. 9 are schematic cross-sectional view showing the operation of the lifting tee of the tee-up part according to the present invention, FIG. 10 to FIG. 11 are schematic cross-sectional view showing the operation of the rotating disk, the link and the tee-up part according to the present invention, FIG. 12 to FIG. 14 are schematic views showing the state where the lifting tee of the tee-up part according to the present invention is inclined, FIG. 15 is a perspective view showing the iron shot hitting part according to the present invention, FIG. 16 is an exploded perspective view of the iron shot hitting part according to the present invention, FIG. 17 is a schematic view showing a control part and a display part according to the present invention, and FIG. 18 is a schematic cross-sectional view of the grass part according to the present invention.

A device for automatically supplying golf balls according to the present invention will be described in detail with reference to FIG. 1 to FIG. 18, in which exemplary embodiments thereof are shown.

The device for automatically supplying golf balls according to the present invention includes a main body 10, a golf ball supplying part 20, a stopper 30, a motor 40, an eccentric cam 50, a golf ball lifting part 60, an inclined guide part 70, an inclined lifting part 80, a rotating disk 90, a tee-up part 100, an iron shot hitting part 200, a control part 250, and a display part 260.

As shown in FIG. 1 to FIG. 5, the body 10 has a plurality of plate members 11*a* and 11*b* which are spaced apart from each other to define a transport space part 11*c*.

In addition, the main body includes a base plate 11*d* which is provided under the two plate members 11*a* and 11*b*.

Specifically, in the front portion of the main body 10, a golf ball inlet port 11*e* is formed. The upper portion of the a golf ball inlet port 11*e* is closed, and a golf ball G enters through the lower portion of the golf ball inlet port 11*e*. The rear and upper portions of the main body 10 are opened.

As shown in FIG. 1 to FIG. 5, the golf ball supplying part 20 is provided in the golf ball inlet port 11*e* which is formed in the front lower portion of the main body 10.

That is, the golf ball supplying part is provided at an incline in the front portion of the main body 10, and is formed as a cylinder that receives a plurality of the golf balls G which are collected. An outlet is formed in the front portion of the cylinder, and an entrance is formed in the rear portion of the cylinder.

The stopper 30 is shown in FIGS. 1 to 5.

The stopper 30 is disposed on the front lower portion of the main body 10. With a hinge 31, the stopper 30 turns to open or close the lower portion of the transport space part 11*c* for the entrance of the golf ball G.

That is, the stopper 30 is disposed in the entrance which is formed in the front portion of the main body 10 such that the stopper 30 faces the outlet of the golf ball supplying part 20. The stopper 30 blocks the golf ball G which are pushed down from the outlet of the golf ball supplying part 20, thereby preventing the golf ball G from entering the transport space part 11*c* through front lower portion of the main body 10.

In addition, a lower fixing protrusion 32*a* is formed on one side of the stopper 30. The lower fixing protrusion 32*a* is connected to a fixing protrusion 32 which is formed on the lower portion of one side of the main body 10 via a first return spring 33.

Specifically, the stopper 30 is configured such that it closes front lower portion of the main body 10 through the compression of the first return spring 33. A catching projection 64*a* formed on one side of the golf ball lifting part 60 which operates in cooperation with the eccentric cam 50 which will be described later compresses the front portion of the upper surface of the stopper 30, thereby lowering the stopper 30. Consequently, the golf ball G enters the transport space part 11*c* of the main body 10 from the outlet of the golf ball supplying part 20. Here, the first return spring 33 expands.

When the golf ball G supplied from the golf ball supplying part 20 is introduced, the stopper 30 closes again front lower portion of the main body 10 through the compression of the first return spring 33, thereby blocking the golf ball G supplied from the golf ball supplying part 20.

Before the foregoing operation, the golf ball lifting part 60 which will be described later transports the golf ball G upward through the operation of the eccentric cam 50 which will be described later, and concurrently, one portion of the lower portion of the golf ball lifting part 60 presses and then releases the upper surface of the stopper 30.

In addition, the stopper 30 includes a guide roll 34 which is positioned in the upper portion and is disposed in the front portion of the main body 10.

The guide roll 34 guides the golf ball G which is introduced into front lower portion of the main body 10 to easily enter the transport space part 11*c* of the main body 10.

As shown in FIG. 1, the motor 40 is disposed in the upper central portion of one side of the main body 10.

As for the eccentric cam 50, as shown in FIG. 2, a drive shaft 41 of the motor 40 is disposed in the transport space part 11*c* in the upper portion of the main body 10 and extends through both the plate members 11*a* and 11*b* of the main body 10.

That is, the drive shaft 41 is disposed in the upper central portion of the inside of the main body 10.

The eccentric cam 50 is mounted on the drive shaft 41 which is disposed as above.

As shown in FIG. 2, a plurality of bearings 51 is disposed on the outer circumference of the eccentric cam 50. With this configuration, the lower portion of a drive bar 64 of the golf ball lifting part 60 which will be described later can be easily pressed and released, and the lifting operation of a lifting bar 83 of the inclined lifting part 80 can be controlled.

As shown in FIG. 2, the golf ball lifting part 60 includes a first pivot shaft 61 disposed in the lower portion in front of the drive shaft 41.

That is, the first pivot shaft 61 is positioned at the lower portion in front of the drive shaft 41 and is disposed inside the main body 10.

A first pivot member 62 is fitted around the outer circumference of the first pivot shaft 61.

The drive bar 64 is disposed on the first pivot member 62. The drive bar 64 is driven in the state where one portion thereof is butted to the inner surface of the plate member 11*a*. The rear portion of the drive bar 64 is butted to the bottom surface of the eccentric cam 50 and is disposed at an incline. A lifting part 63 is provided in front of the drive bar 64. The lifting part 63 is bent toward the other side, and lifts the golf ball G.

The catching projection 64*a* formed on the front portion of the driving bar 64 presses the upper front portion of the stopper 30.

That is, the lower portion of the drive bar 64 connected to the eccentric cam 50 is pressed through the operation of the eccentric cam 50 which is driven by the motor 40, thereby lifting the drive bar 64. At this time, the golf ball G is lifted onto the lifting part 63 provided in front of the drive bar 64, and then is seated on a lifting tee 106 through the inclined lifting part 80 which will be described later.

The rear portion of the drive bar 64 is disposed on the lower portion of the eccentric cam 50 so as to be inclined.

The golf ball G on the lifting part 63 is supplied to the inclined guide part 70 which will be described later.

In addition, a fixing protrusion 67 is provided on the rear portion of the golf ball lifting part 60. The fixing protrusion 67 adjoins the drive shaft 41 and extends through a lift hole 66 formed in one surface of the main body 10 so as to be exposed.

The golf ball lifting part includes a second return spring 69 which connects a lower fixing protrusion 68 formed below the lift hole 66 to the fixing protrusion 67

As the drive bar 40 of the golf ball lifting part 60 is lifted by being compressed by the eccentric cam 50. When the eccentric cam 50 releases the compression, the second return spring 69 is expanded and then compressed. The drive bar 64 is automatically lowered to lower the stopper 30 so that a golf ball is introduced.

As shown in FIG. 2, the inclined guide part 70 is disposed towards the front of the golf ball lifting part 60 and behind the stopper 30.

In addition, the golf ball lifting part 60 supplies the golf ball 100 seated on the lifting part 63 onto a slope 71 of the inclined guide part 70.

The golf ball G which moves downward along the slope 71 of the inclined guide part 70 is supplied to the front portion of the lifting bar 83 which will be described later.

As shown in FIG. 2, the inclined lifting part 80 includes a second pivot shaft 81 which is disposed behind and above the drive shaft 41.

That is, the second pivot shaft 81 is disposed inside the main body 10 so as to be positioned behind and above the drive shaft 41 disposed inside the main body 10.

The lifting bar 83 is disposed in front of a second pivot member 82 which is fitted around the second pivot shaft 81.

The lifting bar 83 of the inclined lifting part 80 has a slope 83*a* which faces the inclined guide part 70 so as to receive the golf ball G which is guided on the inclined guide part 70.

The front portion of the lifting bar 83 is bent.

As the eccentric cam 50 is driven by the motor 40, the outer circumference of the eccentric cam 50 lifts the lower portion of the lifting bar 83.

When the lifting bar 83 is lifted in this fashion, the golf ball G seated on the front portion of the lifting bar 83 is seated onto the lowered lifting tee 106 which will be described later along the slope 83*a* of the lifting bar 83 since the lifting bar 83 is inclined in the opposite direction.

Figure 7:
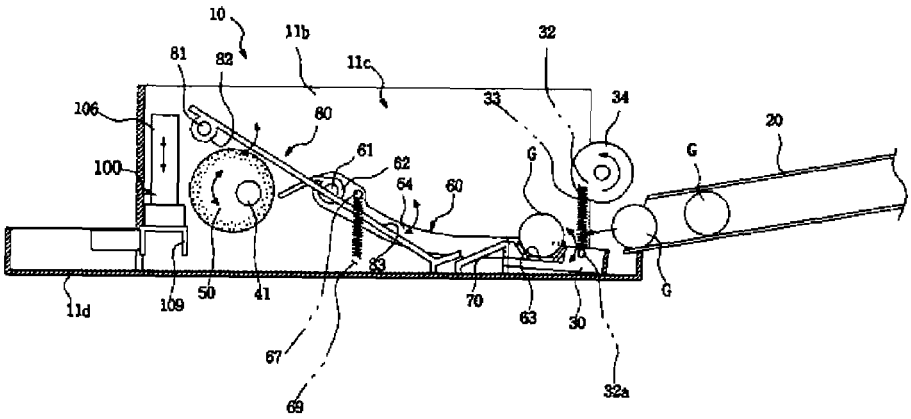
Figure 8:
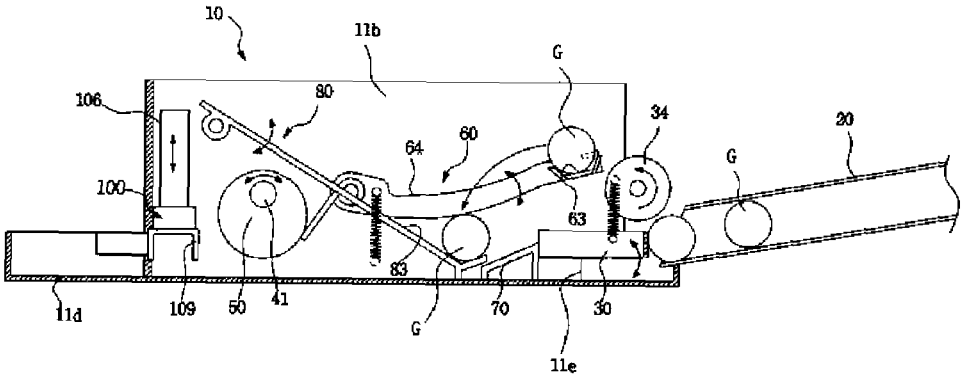
Figure 9:
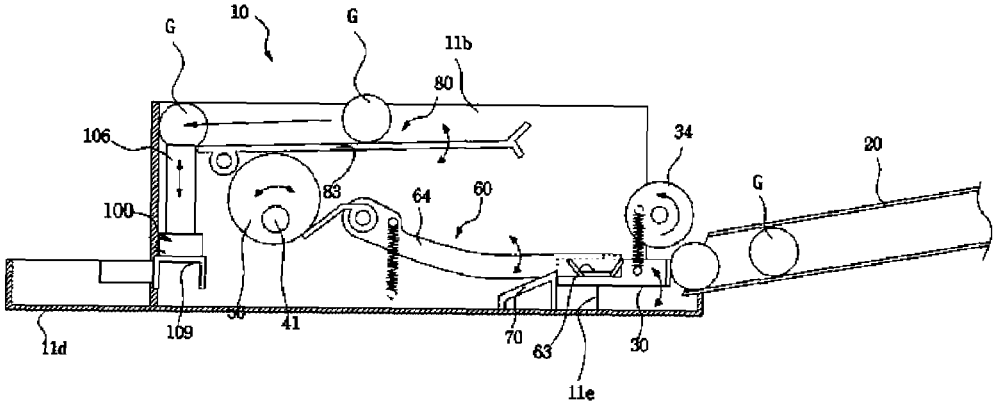

As shown in FIG. 7, the drive shaft 41 is provided with an extension drive shaft 91 which extends through the plate member 11*b*.

The tee-up part 100 is shown in FIG. 1 to FIG. 5 and FIG. 10.

The tee-up part 100 includes a link 104, one end of which is disposed on an exposed drive shaft 41*a* of the drive shaft which extends through the plate member 11*b* so as to be exposed.

The tee-up part includes a gear 91*a* which is disposed behind and below the plate member 11*b*.

The tee-up part includes a chain 92*a*. The front portion of a chain 92*a* is connected to the other end of the link 104, the lower portion of the chain 92*a* moves on the outer circumference of the gear 91*a*, and the rear end of the chain 92*a* is connected to a lifting part 103.

That is, the chain 92*a* is disposed such that the front portion thereof is connected to the other end of the link 104, the rear portion thereof is connected to the lifting part 103, and the lower portion thereof moves on the outer circumference of the gear 91*a*.

In addition, the tee-up part includes a plurality of lifting rods 102 which is disposed on the base plate 11*d*.

The tee-up part includes a lifting plate 105 which is connected to the inner surface of the lifting part 103 which is lifted along the lifting rods 102.

The tee-up part includes the lifting tee 106 which is disposed behind and inward from the lifting plate 105. The lifting tee 106 receives the golf ball G from the inclined lifting part 80.

That is, the golf ball G is seated onto the lifting tee 106.

In addition, as shown in FIG. 5*a* and FIG. 5*b*, the lifting tee 106 has defined therein a space part 106*a*.

The lifting tee has a through-hole 106*b* which is formed under the space part 106*a* so as to communicate with the space part 106*a*.

The lifting tee has a wire 106*c*. One portion of the wire 106*c* is inserted into the through-hole 106*b* and the space part 106*a*, and the other portion of the wire 106*c* is exposed below the through-hole 106*b*.

The lifting tee has upper and lower fixed rings 106*d* and 106*e* which are respectively fixed to the upper and lower portions of the wire 106*c*.

In addition, the lifting tee has an inner movable ring 106*f* which is positioned at the bottom of the space part 106*a*. The wire 106*c* is fitted into the inner movable ring 106*f*.

The lifting tee has an outer movable ring 106*g* which is positioned on the bottom surface of the lifting tee 106. The wire 106*c* is fitted into the outer movable ring 106*g*.

The lifting tee has an inner spring 106*h* which is positioned between the upper fixed ring 106*d* and the inner movable ring 106*f*. The wire 106*c* is fitted into the inner spring 106*h*.

An outer spring 106*i* is positioned between the outer movable ring 106*g* and the lower fixed ring 106*e*, and is fitted around the wire 106*c*.

With this configuration, the wire 106*c* which extends from the inside to the outside of the lifting tee 106, the inner spring 106*h* which is disposed inside the lifting tee 106, and the outer spring 106*i* which is disposed outside the lifting tee 106 perform an elastic action in the top-bottom direction to absorb shock when the lifting tee 106 moves in the lateral or forward-backward direction.

As shown in FIG. 2 and FIG. 3, the tee-up part includes a pivot shaft 107 which extends through the lifting plate 105.

The tee-up part includes a fixing part 109 which has a fixing hole 108 in the rear portion thereof such that the front portion of the pivot shaft 107 is fixed.

The tee-up part further has a fixing hole 110 formed in the portion of the fixing part 109 including the upper portion and the front portion of the fixing part 109. The lower portion of the lifting tee 106 is fixed to the fixing hole 110.

In addition, the tee-up part includes a pivoting part 112 which is disposed on the outer circumference of the pivot shaft 107 which is exposed behind the lifting plate 105.

The tee-up part includes a driving part 114*a* which is provided at one side of the lifting plate 105. The driving part 114*a* has a driving shaft portion 114 which cooperates with a drive motor 113.

The tee-up part includes a third return spring 116 which connects the driving shaft portion 114 to a lower fixing part 115 which is formed on the lower portion of the pivoting part 112.

The pivot shaft 107 is fitted into the fixing hole 108.

The driving shaft portion 114 cooperating with the drive motor 113 is connected to one end of the third return spring 116, and the lower fixing part 115 is connected to the other end of the third return spring 116. When the driving shaft portion 114 and the lower fixing part 115 pivot to one side from the other side, the pivoting part 112 on which the lower fixing part 115 is formed and the pivot shaft 107 pivot from the other side to one side so that the lifting tee 106 disposed on the fixing part 109 fixed to the pivot shaft 107 is inclined from one side to the other side, thereby supplying the golf ball G seated on the lifting tee 106 to the iron shot hitting part 200 which is disposed adjacent to the main body 10.

In addition, a guide recess 111 is formed in the plate member 11*b* which is positioned at the other side of the fixing part 109.

The guide recess 111 is configured to guide one portion of the lifting tee 106 when the lifting tee 106 is inclined from the other side to one side.

A sensor 111*a* is disposed on one side or the other side of the guide recess 111, and detects whether or not the golf ball G is present on the upper surface of the lifting tee 106 when the lifting tee 106 is lowered.

In addition, the tee-up part includes a fixing portion 115*b* which is provided on the upper portion of the driving part 114*a*, an upper fixing portion 115*a* which is provided on the upper portion of the pivoting part 112, and a fourth return spring 117 which connects the fixing portion 115*b* to the upper fixing portion 115*a*.

When the lifting tee 106 is inclined from the other side to one side, the fourth return spring 117 is compressed from the expanded state so that the lifting tee 106 is erected again from one side to the other side.

As shown in FIG. 15 and FIG. 16, the iron shot hitting part 200 is disposed at one side of the main body 10.

In addition, the iron shot hitting part 200 includes a first seating plate 210 disposed at the bottom, a second seating plate 220 seated on the first seating plate 210, a fixing plate 230 seated on the second seating plate 210, and a grass part 240 disposed on the fixing plate.

As shown in FIG. 16, the grass part 240 includes a base plate 241 disposed at the bottom, an elastic member 242 disposed on the base plate 241, and a number of grass seedlings 240*a* disposed on the upper portion of the elastic member.

In addition, a plurality of springs 211 is disposed on the upper periphery of the first seating plate 210.

The springs 211 absorb shock which would otherwise be applied to the second seating plate 220, the fixing plate 230, and the bottom of the grass part 240.

In addition, a plurality of guide recesses 221 is provided on the upper periphery of the second seating plate 220, and a plurality of detection recesses 222 is provided in the central portion of the second seating plate 220.

Transport rolls 223 are disposed in the guide recesses 221, and sensors 224 are disposed in the detection recesses 222.

The guide recesses 221 are disposed at four corners and at the middle of the second seating plate 220.

The plurality of detection recesses 222 is disposed in front of and behind the guide recesses 221 which are disposed at the middle of the second seating plate 220.

The detection recesses 222 are disposed in front of and behind the guide recesses 221 in this fashion such that the golf ball G in the detection recesses 222 is detected by the sensors 224 in the detection recesses 222 as the lower portion of the head of an iron is butted to the detection recesses 222.

Specifically, the golf ball G flies along a path of a normal shot (rear ground) when the head of the iron comes into contact with the detection recesses 222 disposed in front of the guide recesses 221, or flies along a punch shot path close to the ground and then rolls on the ground (front ground) when the head of the iron comes into contact with the detection recesses 221 disposed behind the guide recesses 221, the golf ball G. These are detected and then displayed on the display part 260 so that a gofer or a beginner can correct his/her posture while practicing iron shots.

With the transport rolls 223, the fixing plate 230 and the grass part 240 easily move in the forward-backward direction.

In addition, an exposure hole 231 is formed in each central portion of the fixing plate 230 and the grass part 240 such that the detection recesses 222 of the second seating plate 220 are exposed.

That is, the guide recesses 221 and the detection recesses 222 disposed in front of or behind the guide recesses 221 are exposed, such that the head of the iron comes into contact with and is sensed by the sensors 224 disposed in the detection recesses 222.

In addition, a pressure sensor 225 is disposed on the inner surface of the front portion of the second seating plate 220, a limit switch 226 is disposed adjacent to the pressure sensor 225. The pressure sensor 225 and the limit switch 226 are connected to a control part 250.

The pressure sensor 225 is configured to initialize the operation of the present invention.

The limit switch 226 is intended to automatically guide the golf ball G onto the grass part 240.

As shown in FIG. 18, the grass part 240 includes the number of grass seedlings 240*a* and a protruding grass seedling 240*b* which is provided on the central portion of the grass part 240. The protruding grass seedling 240*b* is longer than the grass seedlings 240*a* in a longitudinal direction.

When the golf ball G is seated on the number of grass seedlings 240*a*, the golf ball G is guided to the central portion of the grass part by the protruding grass seedling 240*b* in order to help a golfer visually recognize and putt the golf ball G on the central portion of the grass part 240.

In addition, the grass seedlings 240 and the protruding glass seedling 240*b* have different colors.

The grass seedlings 240 and the protruding glass seedling 240*b* have different colors in order to help the golfer visually recognize the protruding grass seedling 240*b* from among the grass seedlings 240*a*. Accordingly, the golfer can locate the central portion on the grass part 240.

As shown in FIG. 17, the control part 250 is connected to the display part 260.

In addition, the control part 250 controls the motor 40, the drive motor 113, the sensors 222 and the sensors 224.

The display part 260 includes a liquid crystal display (LCD) window 261, a power ON button 262, a power OFF button 263, a lamp 264 which indicates flying along a path of a normal shot (rear ground), a lamp 265 which indicates flying along a punch shot path close to the ground or rolling on the ground (front ground), and an iron shooting ON/OFF button 266.

In addition, in the grass part 240, the base plate 241 is disposed at the bottom, the elastic member 242 is disposed on the base plate 241, and the number of grass seedlings 240*a* is disposed on the upper portion of the elastic member 242.

A reference will be made to the operation of the present invention in conjunction with FIG. 6 to FIG. 14

In order to practice driver shots, a golfer or a beginner pushes the power ON button 262 on the display part 260.

When the motor 40 is driven, the rear portion of the drive bar 64 of the golf ball lifting part 60 placed on the round portion of the eccentric cam 50 is pressed by the protrusion of the eccentric cam 50 and the catching projection 64*a* at the front portion of the drive bar 64 to press the upper front portion of the stopper 40, thereby opening the front lower portion of the main body 10. One golf ball G from the golf ball supplying part 20 is seated onto the lifting part 63 of the drive bar 64. The drive bar 64 is lifted by the second return spring 69 so that the golf ball is supplied to the slope 71 of the inclined guide part 70. Then, the stopper 30 closes the outlet of the golf ball supplying part 20 due to the elasticity of the first return spring 33.

Afterwards, when the golf ball G on the lifting part 63 of the drive bar 64 is supplied onto the slope 71 of the inclined guide part 70, the golf ball rolls down along the slope 71 and then is seated on the front portion of the lifting bar 83 of the inclined lifting part 80 in front of the slope 71. Then, the lifting bar 83 is lifted by the protrusion of the eccentric cam 50, and the golf ball G is seated onto the lifting tee 106 which is in the lowered position.

In this fashion, the golf ball G is seated onto the lifting tee 106 and lifted along with the lifting tee 106.

When the lifting is completed, the golfer or beginner hits the golf ball G on the lifting tee 106 using a driver.

After the driver shot is performed in this fashion, the lifting tee 106 is lowered through the inverse operation of the above-described operation. Afterwards, the lifting tee 106 is lifted through the normal operation so that a driver shot can be practiced. In this fashion, the normal operation and the inverse operation are repeated so that driver shots can be continuously practiced.

In addition, in order to practice iron shots, the golfer or the beginner pushes the iron shooting ON/OFF button 266 on the display part 260.

When the motor 40 is driven, the rear portion of the drive bar 64 of the golf ball lifting part 60 placed on the round portion of the eccentric cam 50 is pressed by the protrusion of the eccentric cam 50 and the catching projection 64*a* at the front portion of the drive bar 64 to press the upper front portion of the stopper 40, thereby opening the front lower portion of the main body 10. One golf ball G from the golf ball supplying part 20 is seated onto the lifting part 63 of the drive bar 64. The drive bar 64 is lifted by the second return spring 69 so that the golf ball is supplied to the slope 71 of the inclined guide part 70. Then, the stopper 30 closes the outlet of the golf ball supplying part 20 due to the elasticity of the first return spring 33.

Afterwards, when the golf ball G on the lifting part 63 of the drive bar 64 is supplied onto the slope 71 of the inclined guide part 70, the golf ball rolls down along the slope 71 and then is seated on the front portion of the lifting bar 83 of the inclined lifting part 80 in front of the slope 71. Then, the lifting bar 83 is lifted by the protrusion of the eccentric cam 50, and the golf ball G is seated onto the lifting tee 106 which is in the lowered position.

While the above-described operation is being performed, when the sensor 111*a* detects the golf ball G on the lifting tee 106, the sensor 111*a* sends a signal to the control part 250, which then operates the motor 40 to drive the eccentric cam 50. The eccentric cam 50 releases pressing the rear portion of the drive bar 64, and the second return spring 69 is released from expanding. Then, the front portion of the drive bar 64 is lowered to press the stopper 30 downward. The stopper 30 which has been blocking the golf ball G is lowered to guide the golf ball G to the golf ball inlet port 11*e* so that the golf ball G is seated onto the lifting part 63 of the drive bar 64. Afterwards, through the rotation of the eccentric cam 50, the rear portion of the drive bar 64 is pressed so that the drive bar 64 and the lifting part 63 are lifted so that the golf ball G is supplied from the lifting part 63 to the inclined guide part 70.

Here, the golf ball G stays on the upper portion of the inclined guide part 70, and when the inclined guide part 80 is lowered as the driven eccentric cam 50 interferes with the rear portion of the inclined guide part 80, is supplied to the inclined guide part 80.

After the golf ball G is supplied to the front portion of the inclined guide part 80 in this fashion, the eccentric cam rotates and interferes with the rear portion of the inclined guide part 80 so that the inclined guide part 80 is lifted.

Consequently, the golf ball G is supplied onto the lifting tee 106 which is disposed behind the inclined guide part 80.

When the golf ball G is supplied to the upper portion of the lifting tee 106, the golfer can repeatedly practice driver shots.

In addition, as shown in FIG. 10 and FIG. 11, when the golf ball G is seated on the lifting tee 106, the drive shaft 41 of the eccentric cam 50 for lifting the lifting bar 83 rotates the link 104 connected to the exposed drive shaft 41*a* which is disposed on the drive shaft 41 exposed to the plate member 11*b* so as to draw the chain 92*a*. Then, the lifting part 103 connected to the rear portion of the chain 92*a* is lifted. At this time, the lifting plate 105 connected to the lifting part 103 and the lifting tee 106 disposed on the lifting plate 105 are also lifted.

As the lifting tee 106 is lifted in this fashion, the golf ball G seated on the lifting tee 106 is lifted along with the lifting tee 106.

The lifting tee 106 is lowered through the inverse operation of the above-described operation.

At this time, the driving shaft portion 114 cooperating with the drive motor 113 is connected to one end of the third return spring 116, and the lower fixing part 115 is connected to the other end of the third return spring 116. During the operation of the drive motor 113, when the driving shaft portion 114 and the lower fixing part 115 pivot from the other side to one side, the pivoting part 112 having the lower fixing part 115 and the pivot shaft 107 pivot from the other side to one side. The lifting tee 106 disposed on the fixing part 109 fixed to the pivot shaft 107 is inclined from one side to the other side. Then, the golf ball G seated on the lifting tee 106 is supplied onto the iron shot hitting part 200 which is disposed at one side of the main body 10. The fourth return spring 117 causes the lifting tee 106 to be inclined from one side to the other side and then be erected again from the other side to one side.

Then, the golfer or the beginner can practice iron shots by hitting the golf ball G seated on the iron shot hitting part 200 using an iron.

While the operation is being performed as above, when the sensor 111*a* detects that the golf ball G is supplied from the inclined guide part 70 to the lifting tee 106 through the inclined lifting part 80, the driving shaft portion 114 cooperating with the drive motor 113 is connected to one end of the third return spring 116, and the lower fixing part 115 is connected to the other end of the third return spring 116. During the operation of the drive motor 113, when the driving shaft portion 114 and the lower fixing part 115 pivot from the other side to one side, the pivoting part 112 having the lower fixing part 115 and the pivot shaft 107 pivot from the other side to one side. The lifting tee 106 disposed on the fixing part 109 fixed to the pivot shaft 107 is inclined from one side to the other side. Then, the golf ball G seated on the lifting tee 106 is supplied onto the iron shot hitting part 200 which is disposed at one side of the main body 10.

When the golf ball G is supplied onto the iron shot hitting part 200 in this fashion, the golfer practices iron shots.

While the iron shooting operation is being performed as above, the head of the iron of the golfer is rubbed against the grass part 240 so that the fixing plate 230 coupled to the lower portion of the grass part 240 is moved forward and returns backward. At this time, the front portion of the fixing plate 230 turns on the limit switch 226 disposed inside the front portion of the second seating plate 220 so that the lifting tee 106 is inclined again from one side to the other side. Then, the golf ball G supplied onto the lifting tee 106 through the inclined lifting part 80 and the drive bar 64 is supplied onto the iron shot hitting part 200 so that the golfer can practice an iron shot.

This operation is repeated performed so that the golfer can continuously practice iron shots.

Since the above-described operation is repeatedly performed, the golfer or the beginner can correct his/her posture by continuously practicing iron shots.

Accordingly, the present invention enables the golfer to practice drive and iron shots selectively or iron shots or concurrently.

The embodiments of the present invention that have been described above are merely illustrative and various modifications and equivalents are possible to a person skilled in the art. It can be therefore understood that the present invention is not limited to those described in conjunction with the foregoing embodiments.

Therefore the true scope of the present invention shall be defined the technical principle of the appended Claims. It should be understood therefore that the present invention embrace any modifications, equivalents and substitutions thereof fall within the spirit and the scope of the present invention defined by the Claims appended hereto.

DESCRIPTION OF THE REFERENCE NUMERALS IN THE DRAWINGS

10: main body
11*a*, 11*b*: plate member
11*c*: transport space part
20: golf ball supplying part
30: stopper
31: hinge
32: fixing protrusion
32*a*: lower fixing protrusion
33: first return spring
34: guide roll
40: motor
41: drive shaft
41*a*: exposed drive shaft
50: eccentric cam
51: bearing
60: golf ball lifting part
61: first pivot shaft
62: first pivot member
63: lifting part
64: drive bar
64*a*: catching projection
66: lift hole
67: fixing protrusion
68: lower fixing protrusion
69: second return spring
70: inclined guide part
71: slope
80: inclined lifting part
81: second pivot shaft
82: second pivot member
83: lifting bar
83*a*: slope
91*a*: gear
92*a*: chain
100: tee-up part
101: central movement hole
102: lifting rod
103: lifting part
104: link
105: lifting plate
106: lifting tee
106*a*: space part
106*b*: through-hole

106*c*: wire
106*d*: upper fixed ring
106*e*: lower fixed ring
106*f*: inner movable ring
106*g*: outer movable ring
106*h*: inner spring
106*i*: outer spring
107: pivot shaft
108: fixing hole
109: fixing part
110: fixing hole
111: guide recess
112: pivoting part
113: drive motor
114: drive shaft portion
114*a*: driving part
115: lower fixing portion
115*a*: upper fixing portion
116: third return spring
117: fourth return spring
118: protruding reinforcement plate
200: iron shot hitting part
210: first seating plate
211: spring
220: second seating plate
221: guide recess
222: detection recess
223: transport roll
224: sensor
225: pressure sensor
226: limit switch
230: fixing plate
231: exposure hole
240: grass part
241: base plate
242: elastic member
240*a*: grass seedling
240*b*: protruding grass seedling
250: control part
260: display plat
G: golf ball

The invention claimed is:

1. A device for automatically supplying golf balls comprising:

a main body (10) comprising a plurality of plate members (11*a*, 11*b*) which are spaced apart from each other to define a transport space part (11*c*);

a golf ball supplying part (20) disposed in a front lower portion of the main body (10);

an eccentric cam (50) disposed on a drive shaft (41) of a motor (40) disposed on an upper central portion of one surface of the main body (10), the drive shaft (41) being disposed in the transport space part (11*c*);

a golf ball lifting part (60) comprising a drive bar (64) for receiving a golf ball (G) from the golf ball supplying part (20), wherein the drive bar is connected to a first pivot member fitted around a first pivot shaft (61) disposed in front of the drive shaft (41), a rear portion of the drive bar is inclined in a back to front direction so as to be driven through an operation of the eccentric cam (50), and the drive bar has a lifting part (63) in a front portion thereof;

an inclined guide part (70) disposed towards the front of the golf ball lifting part (60) and behind a stopper (30), the inclined guide part comprising a slope (71) for receiving the golf ball (G) lifted on the golf ball lifting part (60);

an inclined lifting part (80) disposed in front of a second pivot member (82) fitted around a second pivot shaft (81) disposed behind and above the drive shaft (41), the inclined lifting part comprising a lifting bar (83) having a slope (83*a*) which faces the inclined guide part (70) so as to receive the golf ball (G) guided on the inclined guide part (70); and a tee-up part (100) comprising a link (104), wherein one end of the link is disposed at an exposed drive shaft (41*a*) of the drive shaft (41) which extends through the plate member (11*b*) so as to be exposed, a gear (91*a*) disposed behind and above the plate member (11*b*), and a chain (92*a*), wherein a front portion of the chain is connected to the other end of the link (104), a lower portion of the chain moves on an outer circumference of the gear (91*a*), and a rear portion of the chain is connected to a lifting part (103).

2. The device of claim 1, wherein the stopper (30) is disposed between the golf ball supplying part (20) and the golf ball lifting part (60), wherein the stopper is disposed in a front lower portion of the main body (10), the stopper pivots on a hinge (31) in order to open and close an outlet of the golf ball supplying part (20) so that the golf ball (G) enters and exits a lower portion of the transport space part (11*c*), and a lower fixing protrusion (32*a*) is formed on the stopper and is disposed using a first return spring (33) so as to be connected to a fixing protrusion (32) formed on a portion of the main body (10).

3. The device of claim 1, wherein the drive bar (64) of the golf ball lifting part (60) is disposed on the first pivot member (62), is driven with one portion thereof being butted to an inner surface of the plate member (11*a*), and is inclined with a rear portion thereof being butted to a bottom surface of the eccentric cam (50), and a front portion of the drive bar is bent toward the other side to provide a lifting part (63) which lifts the golf ball (G), and wherein a catching projection is provided on a front portion of the drive bar (64), and presses an upper front portion of the stopper (30).

4. The device of claim 1, wherein the tee-up part comprises a plurality of lift rods (102) which is disposed on a base plate (11*d*), a lifting plate (105) which is connected to an inner surface of the lifting part (103) which is lifted along the plurality of lift rods (102), and a lifting tee (106) which is disposed behind and inward from the lifting plate (105) to receive the golf ball (G) from the inclined lifting part (80).

5. The device of claim 1, wherein the golf ball lifting part (60) comprises a lift hole (66) formed in a surface of the main body (10), a fixing protrusion (67) disposed on a rear portion of the golf ball lifting part, the fixing protrusion adjoining the drive shaft (41) and extending through the lift hole (66) so as to be exposed, a lower fixing protrusion (68) formed below the lift hole, and a second return spring (69) connecting the fixing protrusion (67) to the lower fixing protrusion (68).

6. The device of claim 1, wherein the golf ball supplying part (20) is formed as a cylinder that a plurality of the golf balls (G) enters and exits, and is disposed in front of the main body (10) at an incline.

7. The device of claim 4, wherein the tee-up part further comprises a pivot shaft (107) which extends through the lifting plate (105), a fixing part (109) which has a fixing hole (108) in a rear portion thereof to which a front portion of the pivot shaft (107) is fixed, and a fixing hole (110) which is formed in an upper portion and a front portion of the fixing part (109) which are connected to each other, wherein a lower portion of the lifting tee (106) is fixed to the fixing hole (110).

8. The device of claim 7, wherein a guide recess (111) is formed in the plate member (11*b*) positioned at the other side of the fixing part (109).

9. The device of claim 7, wherein the tee-up part further comprises a pivoting part (112) which is disposed on an outer circumference of the pivot shaft (107) exposed behind the lifting plate (105), a driving part (114*a*) which is provided at one side of the fixing part (109) and has a driving shaft portion (114) communicating with the drive motor (113), and a third return spring (116) which connects the driving shaft portion (114) to a lower fixing part (115) formed on a lower portion of the pivoting part (112).

10. The device of claim 9, wherein the tee-up part further comprises a fourth return spring (117) which connects an upper portion of the driving part (114*a*) to an upper fixing portion (115*a*) formed on an upper portion of the pivoting part (112).

11. The device of claim 1, wherein an iron shot hitting part (200) is provided at one side of the main body (10).

12. The device of claim 11, wherein the iron shot hitting part (200) comprises a first seating plate (210) disposed at a bottom, a second seating plate (220) seated on the first seating plate (210), a fixing plate (230) seated on the second seating plate (220), and a grass part (240) disposed on the fixing plate.

13. The device of claim 12, wherein the first seating plate (210) comprises a plurality of springs (211) disposed on an upper periphery thereof.

14. The device of claim 12, wherein the second seating plate (220) comprises a plurality of guide recesses (221) formed in an upper periphery thereof and a plurality of detection recesses (222) formed in a central portion thereof.

15. The device of claim 14, wherein transport rolls (223) are disposed in the guide recesses (221), and sensors (224) are disposed in the detection recesses (222).

16. The device of claim 12, wherein each of the fixing plate (230) and the grass part (240) has an exposure hole (231) in a central portion thereof through which the detection recesses (222) of the second seating plate (220) are exposed.

17. The device of claim 1, wherein the iron shot hitting part further comprises a control part (250) which controls the motor (40) and the drive motor (113).

18. The device of claim 15, wherein the sensors (224) are controlled by the control part (250).

19. The device of claim 18, wherein the control part (250) is connected to a display part (260).

20. The device of claim 7, wherein the lifting tee (106) comprises a space part (106*a*) formed inside the lifting tee, a through-hole (106*b*) formed in a lower portion of the space part (106*a*) to communicate with the space part (106*a*), a wire (106*c*), a portion of the wire being inserted into the through-hole (106*b*) and the space part (106*a*), and another portion of the wire being exposed below the through-hole (106*b*), upper and lower fixed rings (106*d*, 106*e*) respectively fixed to upper and lower portions of the wire (106*c*), an inner movable ring (1060 positioned at a bottom of the space part (106*a*), the wire (106*c*) being fitted into the inner movable ring (1060, an outer movable ring (106*g*) positioned on a bottom surface of the lifting tee (106), the wire (106*c*) being fitted into the outer movable ring (106*g*), an inner spring (106*h*) positioned between the upper fixed ring (106*d*) and the inner movable ring (1060, the wire (106*c*) being fitted into the inner spring (106*h*), and an outer spring (106*i*) positioned between the outer movable ring (106*g*) and the lower fixed ring (106*e*), the wire (106*c*) being fitted into the outer spring (106*i*).

21. The device of claim 12, wherein the grass part (240) comprises a base plate (241) disposed at a bottom, an elastic member (242) disposed on the base plate (241), and a number of grass seedlings (240*a*) disposed on an upper portion of the elastic member (242).

22. The device of claim 12, wherein the second seating plate (220) comprises a pressure sensor (225) and a limit switch (226) disposed on a front inner portion thereof, the pressure sensor (225) being connected to the control part (250).

23. The device of claim 1, wherein the eccentric cam (50) comprises a plurality of bearings (51) disposed on an outer circumference of the eccentric cam.

24. The device of claim 1, wherein the stopper (30) comprises a guide roll (34) which is positioned above the stopper (30) and is disposed in a front portion of the main body (10).

25. The device of claim 12, wherein the grass part (240) comprises a number of grass seedlings (240*a*) and a protruding grass seedling (240*b*), the protruding grass seedling being provided on a central portion of the grass part (240) and is longer than the number of grass seedlings (240*a*) in a longitudinal direction.

26. The device of claim 25, wherein the number of grass seedlings (240*a*) and the protruding grass seedling (240*b*) have different colors.

27. The device of claim 21, wherein the grass part (240) comprises a number of grass seedlings (240*a*) and a protruding grass seedling (240*b*), the protruding grass seedling being provided on a central portion of the grass part (240) and is longer than the number of grass seedlings (240*a*) in a longitudinal direction.

* * * * *